United States Patent [19]

Leroy

[11] 4,138,098

[45] Feb. 6, 1979

[54] METHOD OF BLOWING SMELTING SHAFT FURNACES AND TUYERES USED FOR SAID BLOWING

[75] Inventor: Pierre Leroy, Saint-Germain-en-Laye, France

[73] Assignee: Creusot-Loire, Paris, France

[21] Appl. No.: 712,325

[22] Filed: Aug. 6, 1976

[30] Foreign Application Priority Data

Aug. 14, 1975 [FR] France ..... 75 27370
Oct. 21, 1975 [FR] France ..... 75 32091

[51] Int. Cl.[2] ..... C21B 7/16; C21C 5/48
[52] U.S. Cl. ..... 266/268; 266/186
[58] Field of Search ..... 75/41, 42, 59; 110/182.5; 122/6.6; 266/47, 197, 186, 222, 268, 269, 270

[56] References Cited

U.S. PATENT DOCUMENTS

| | | | |
|---|---|---|---|
| 936,781 | 10/1909 | Kemp | 266/186 X |
| 3,701,517 | 10/1972 | Gray | 266/222 |
| 3,706,549 | 12/1972 | Knuppel et al. | 266/222 X |
| 3,794,308 | 2/1974 | Ponghis et al. | 266/270 X |
| 3,823,931 | 7/1974 | Wells et al. | 266/222 X |
| 3,844,767 | 10/1974 | Rheinlander | 75/42 |
| 3,844,768 | 10/1974 | Leroy et al. | 75/59 |
| 3,891,429 | 6/1975 | Cox et al. | 75/59 X |
| 3,897,048 | 7/1975 | Pearce et al. | 266/222 |
| 3,917,243 | 11/1975 | Borgnat et al. | 266/270 X |
| 4,043,541 | 8/1977 | Sprunck | 266/268 |

*Primary Examiner*—Roy Lake
*Assistant Examiner*—Paul A. Bell
*Attorney, Agent, or Firm*—Haseltine, Lake & Waters

[57] ABSTRACT

In the blowing of smelting shaft furnaces tuyeres are used which are not water-cooled and which comprise three concentric conduits leading directly into the furnace, the central conduit receiving the hot blast, the intermediate conduit receiving an oxidizing gas which is not preheated and the outer conduit receiving a fluid or emulsion containing hydrocarbons.

3 Claims, 4 Drawing Figures

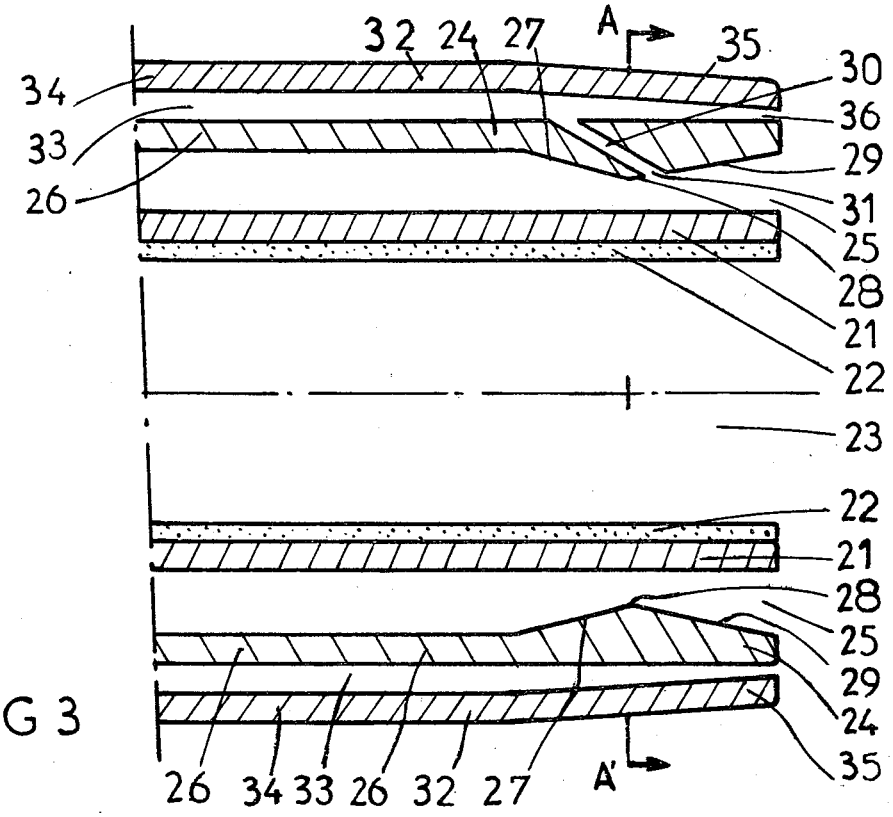
FIG 3
FIG 4
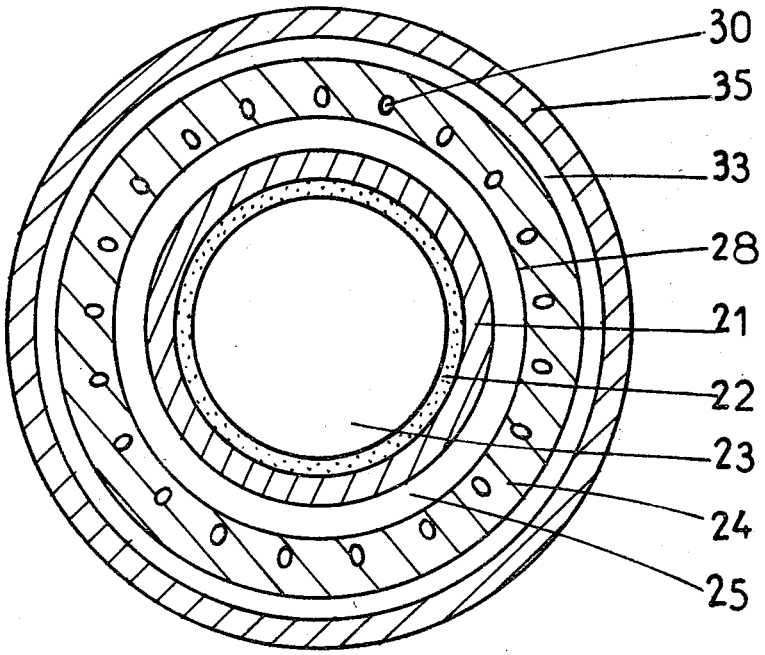

METHOD OF BLOWING SMELTING SHAFT FURNACES AND TUYERES USED FOR SAID BLOWING

The present invention concerns a method of blowing smelting shaft furnaces, particularly but not exclusively blast furnaces.

Known tuyeres for blast furnaces are made of copper or copper alloy and are cooled by circulating water, having a water inlet and a water outlet. They are embedded in the refractory wall of the blast furnace and their ends project into the furnace, where they are very exposed. Various running problems can result, and the life of such tuyeres rarely exceeds twelve months in medium size blast furnaces, being even less in very large modern furnaces.

Attempts have been made to manufacture tuyeres for blast furnaces with a metal, e.g. nickel or cobalt based, or chromium, or ceramic coating on the copper, the ceramic being based on aluminium or zirconium, with or without an intermediate cermet coating, combining the aforementioned bases.

In certain cases these recent tuyere designs have shown a slight improvement over their predecessors in terms of working life. The improvement is not decisive, however, when the additional cost of the special coatings is taken into account, and especially considering that the various disadvantages of current blowing methods using water-cooled tuyeres are retained.

Two of these disadvantages warrant special mention as they are characteristic of current blowing conditions in blast furnaces, and so of the operation of the furnaces themselves.

First, fuel oil is generally injected by means of uncooled side pipes which pass obliquely through the wall of the nozzles which supply the hot blast to the tuyeres.

Secondly, the blast is oxygen enriched upstream of the Cowper's stoves, so that it is the enriched blast which is pre-heated.

In the known blowing methods as a whole, the result of these two factors is that the input of fuel oil is in practice limited to 100 kg per tonne of pig iron, and that the enriching of the blast is in practice limited to a maximum of 26% oxygen, which is however rarely achieved.

According to one aspect of the present invention there is provided a method of blowing a smelting shaft furnace by means of a tuyere which is not water-cooled and which comprises three concentric conduits being a central conduit receiving the hot blast, an intermediate annular conduit and an outer annular conduit, wherein an oxidising gas which is not pre-heated is blown in said intermediate conduit, the oxidising gas being chosen from the group consisting of oxygen-enriched air, a mixture of oxygen and water vapour, a mixture of oxygen and carbon dioxide, pure oxygen loaded with water vapour, and pure oxygen, and a fluid or emulsion containing hydrocarbons is introduced into said outer conduit whence it passes directly into the furnace.

The hot blast may consist of hot air which is not enriched with oxygen. It may alternatively be slightly enriched with oxygen.

The oxidising gas which is not pre-heated may contain suspended particles of chalk or limestone.

The fluid containing hydrocarbons may be preheated heavy fuel oil, or light fuel oil, pre-heated or not, or domestic fuel oil, or a gas such as propane, butane or natural gas, or an emulsion of water vapour or droplets in fuel oil.

The flow rates and pressures of the hot blast, oxidising gas, powdered material, and fluid or emulsion containing hydrocarbons are controlled in accordance with the blast furnace rating to be achieved, taking into account the permeability of the charge.

When the delivery of oxidising gas or hydrocarbons is interrupted, these fluids may be replaced by a scavenging blast of air, nitrogen or water vapour.

In accordance with another aspect of the present invention there is provided a tuyere for a blast furnace which is not water-cooled and which comprises at least one metal component defining three concentric conduits, a central conduit for receiving the hot blast and two annular conduits, all three conduits leading directly into the blast furnace with no other fluid outlet.

The metal component or components making up the tuyere may be cast and/or machined and/or welded. It or they may with advantage be made from copper or stainless steel.

The tuyere advantageously consists of three concentric tubes which are centred with respect to one another. The inner tube may be made of ordinary steel for temperature of the hot blast from 900° C. to 950° C. and of stainless steel for temperatures of the hot blast above 950° C. The inner tube can usefully be provided with an inside coating of refractory material, such as cast refractory concrete, for example.

The intermediate tube may be made of copper, and the outer tube may be made of ordinary steel.

At a small distance from the tip of the tuyere small diameter channels may be provided to provide communication between the outer conduit for the fluid or emulsion containing hydrocarbons, and the intermediate conduit for the oxygen or oxidising gas, so that part of the flow of hydrocarbons is atomized in the stream of oxygen or oxidising gas just before it leaves the tuyere, the remainder of the flow of hydrocarbons continuing in the outer conduit, the cross-section of which is progressively reduced, preferably to a slightly greater degree than that corresponding to the ratio of the two parts of the hydrocarbon flow.

Advantageously the inside surface of the outer wall of the intermediate conduit for the oxygen or oxidising gas has a venturi profile comprising a convergent portion, a throat and a divergent portion, and the small diameter channels terminate in a ring of small orifices which open into the divergent portion at a small distance from the throat.

It will be appreciated that using the above described method and tuyere improved combustion of the hydrocarbons can be obtained while the tuyere is protected in an effective manner from deterioration caused by that part of the fluid or emulsion containing the hydrocarbons which continues to flow in the outer conduit.

As will be understood, the above described blowing method makes use of the hydrocarbons both to protect the tuyere from wear and as a chemical reducing agent inside the blast furnace, and makes use of the oxidising gas, which is not pre-heated, both as a coolant in the tuyere and as an oxidising agent in the furnace.

It is the thermal and chemical double role of the hydrocarbons and of the oxidising gas which permit elimination of circulating cooling water.

It is essential that the hot blast does not come into contact with the hydrocarbons in the tuyere, on either side of a single tube, as there would then be a risk of carbon becoming deposited on the walls of the hydrocarbon conduit. It is for this reason that the oxidising gas is introduced, without pre-heating, as a heat insulator between the central hot blast and the hydrocarbons which are introduced into the periphery of the tuyere to protect it against wear when hot.

As far as is possible and for the same reasons, it is preferable where the tuyere consists of three concentric tubes for the central tube to be of steel, which has only a moderate thermal conductivity to limit as far as possible heat transfer from the hot blast to the oxidising gas, and for the intermediate tube to be of copper, which has very high thermal conductivity, to favour as much as possible transfer of heat from the hydrocarbons to the oxidising gas.

Advantageously the tuyere also includes a refractory lining on the inside face of the central tube where this carries the hot blast, so that the hydrocarbons are well insulated thermally from the hot blast.

The invention will be more fully understood from the following description of embodiments thereof, given by way of example only, with reference to the accompanying drawings, in which:

FIG. 3 is a longitudinal section through the downstream part of a second embodiment of tuyere in accordance with the invention; and FIG. 4 is a section on the line A—A' of FIG. 3.

Figure 1:
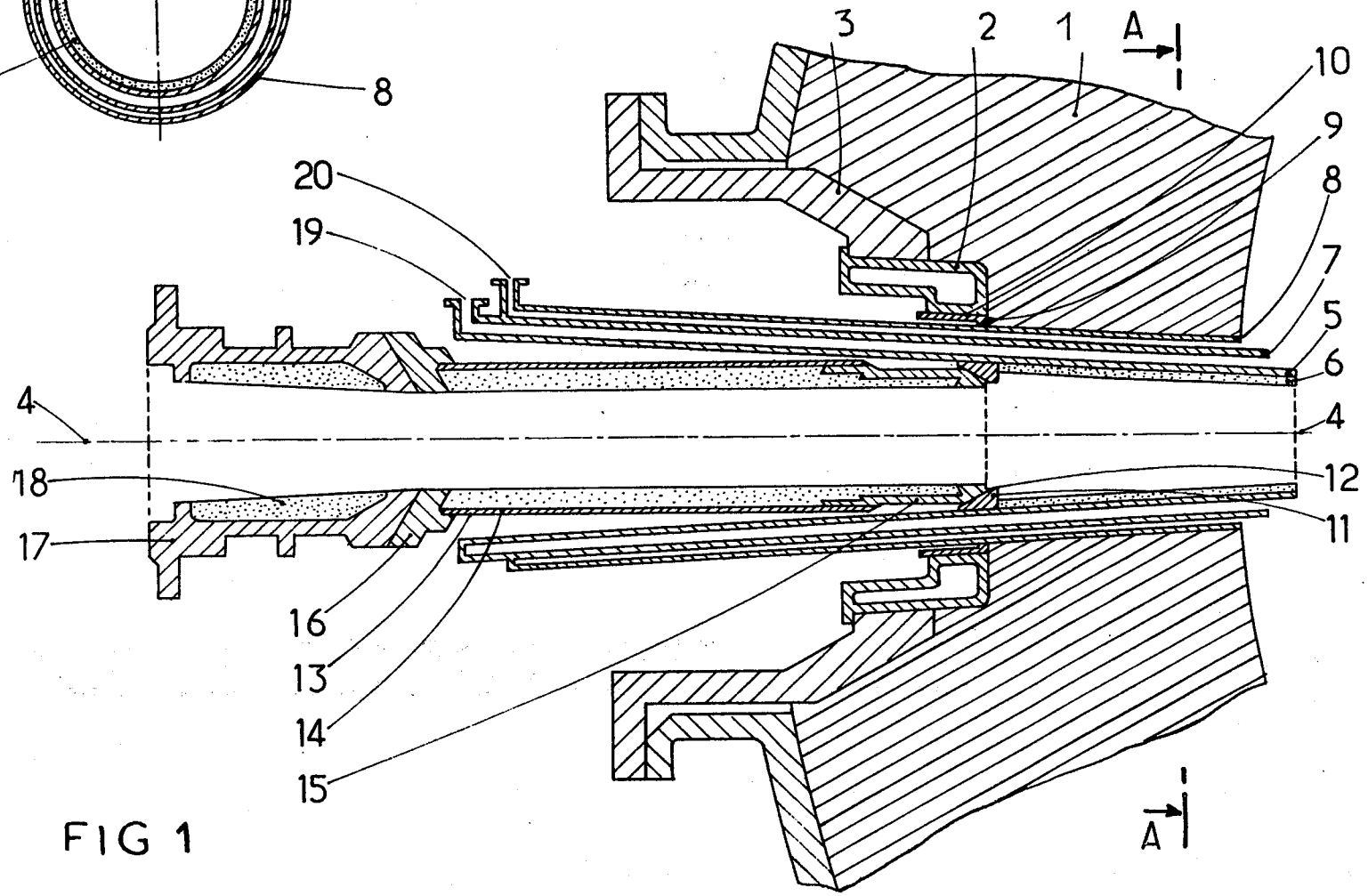
FIG. 1 is a longitudinal section through a first embodiment of tuyere in accordance with the invention, showing a known type of nozzle through which the tuyere is supplied with the hot blast.

Referring to FIG. 1, as for known types of tuyere, the refractory wall 1 of the blast furnace has an opening for the tuyere, fitted with a water-cooled tymp 2 and an uncooled metal member 3.

Figure 2:
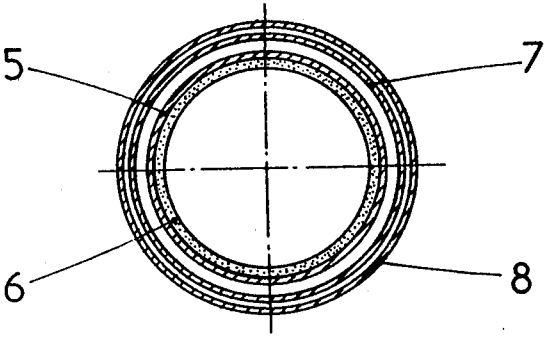
FIG. 2 is a section on the line A—A' of FIG. 1.

The tuyere shown in FIGS. 1 and 2 has an axis of revolution 4 and comprises three concentric tubes, namely:

(a) a central tube 5 of stainless steel with its inner face lined with a thin layer of cast refractory concrete 6, (b) a copper intermediate tube 7, and (c) an outer tube 8 of ordinary steel.

The tube 5 is centred in the tube 7 and the tube 7 in the tube 8 very accurately, by any known means, such for example as bosses of very accurately determined height for example.

The tuyere is solidly located in the tymp 2 by means of a guide element 9 of cast steel, which matches the tymp 2 at 10 by means of an appropriate conicity. The element 9 is attached to the outer tube 8 of the tuyere by any suitable means.

On the inside face of the inner tube 5 is fixed a metal ring 11 with a conical inner face 12 acting as a stop. A nozzle 13 which is of known type abuts the conical face 12 of the element 11. The nozzle comprises a tube 14 welded to a head 15 which has a conical forward profile which matches the conical face 12 of the element 11. It is lined with a layer of cast refractory concrete 15'. At its upstream end the tube 14 is welded to a base ring 16. A member 17 provided with a lining 18 of refractory concrete connects the nozzle 13 to the blast connection (not shown).

The hot blast, which is not enriched with oxygen, passes through the blast connection and the nozzle 13 in the known manner, into the tuyere. In the tuyere it is in contact only with the layer 6 of cast refractory concrete. This layer 6 and the inner tube 5 which carries it project a small distance into the blast furnace.

The gap between the central tube 5 of the tuyere and the intermediate tube 7 serves for the blowing of cold pure oxygen, which is introduced tangentially through orifice 19.

Likewise orifice 20 serves for the tangential introduction of fluid which contains hydrocarbons, which flows between the intermediate tube 7 and the outside tube 8 of the tuyere. In the present example, this fluid is preheated heavy fuel oil.

The outer tube 3 terminates at the inner surface of the refractory wall 1 of the blast furnace, whereas the intermediate tube 7 extends a short distance into the furnace, this distance being less than the distance the inner tube 5 projects. In this way the fuel oil is fully able to carry out its role of protecting the tuyere and the refractory lining of the blast furnace from wear, while also taking part in combustion with the pure oxygen and the hot blast, before exerting a reducing effect on the charge by the action of carbon monoxide and hydrogen.

The tuyere shown in FIGS. 3 and 4 has a downstream portion comprising, from the inside towards the outside;

(a) a metal component 21 which may be cylindrical or part-conical and is lined with an insulative refractory layer 22, the inside of which constitutes a conduit 23 through which the hot blast passes, the hot blast consisting of air pre-heated in the Cowper's stoves and not enriched with oxygen;

(b) a metal component 24 concentric with the component 21 and defining with component 21 a conduit 25 for delivering pure oxygen or unheated oxidising gas, the component 24 being cylindrical on the outside but having an inner surface comprising a cylindrical portion 26 followed by a convergent section 27 followed by a throat 28 followed by a divergent section 29. The component 24 is provided with a ring of small oblique channels 30 which open at 31 into the divergent section 29 a small distance from the throat 28. The ring of small channels is clearly visible in FIG. 4;

(c) a metal component 32 concentric with the components 21 and 24, defining with the component 24 a conduit 33 for delivering the fluid or emulsion which contains the hydrocarbons, the component 32 having a portion 34 which has cylindrical inner and outer surfaces and a portion 35 extending up to the tip of the tuyere which has part conical inner and outer surfaces.

The sum of the area of the annular outlet 36 of the conduit 33 and the flow areas of the ring of oblique channels 30 must be less than the area of the annular passage of the conduit 33 between the cylindrical portion 26 of the component 24 and the cylindrical portion 34 of the component 32, so that the fluid or emulsion containing the hydrocarbons always flows under pressure and without the boundary layer becoming detached, in the oblique channels 30 just as much as in the conical portion 35 of the component 32.

The three metal components 21, 24 and 32 may be entirely separate or parts of a single large component.

The downstream section of the tuyere shown in FIG. 3 can either be part of a single large component constituting the whole of the tuyere or joined by welding or any other known method to an upstream section appropriately supplying the three conduits 23, 25 and 33.

The proper centering of each of the components 21, 24 and 32 with respect to one another is effected by any known means, such as bosses, helicoidal vanes, distance pieces, or the like (not shown).

It will be appreciated that the blowing method using tuyeres as described above differs in important respects from known blowing methods, and has many advantages including:

(a) Firstly, all operating problems associated with the use of known types of water-cooled tuyere are eliminated.

(b) The hottest zone is no longer on the tuyere axis at a distance from the tip of the tuyere. It is situated at the periphery of the composite jet made up of the hot blast and the pure oxygen or oxidising gas. It involves a greater volume of the charge, and is therefore better spread out. As a result, the ratio of oxygen to the hot blast flow can be substantially increased without disadvantage, and consequently the flow of fuel oil significantly increased. It becomes possible in this way to consume more than 110 kg of fuel oil per tonne of pig iron, i.e. to use more than 100 grammes of fuel oil per $Nm^3$ of hot blast, and to have more than 26% oxygen in the combined flows of the hot blast and the pure oxygen or the oxidising gas.

(c) Using the above described method, it is no longer necessary to introduce oxygen into the blast before pre-heating, as the requirement is for cold oxygen in the tuyere. The whole of the heat available in the Cowper's stoves is therefore used for pre-heating the ordinary air which constitutes the hot blast. The consumption of hot blast per tonne of iron is lower, since the proportion of pure oxygen can be substantially increased. This reduction in the consumption of ordinary air per tonne of iron must of course remain within reasonable bounds, but the only limit now is the minimum volume of nitrogen ballast needed to fulfil the role of thermal vehicle in the shaft of the blast furnace. There is thus a gain in terms of the heat provided by the Cowper's stoves, and in terms of the quantity of ordinary air consumed.

(d) The increased consumption of fuel oil and oxygen must of course be paid for, but this is compensated by the saving realised in the consumption of coke.

To sum up, the above described blowing method has very important advantages with regard to the running or the economics of the blast furnace and the service maintenance of the tuyeres.

It will be evident that without departing from the scope of the invention it is possible to conceive of modifications and improvements of detail and of the use of equivalent means.

For example, powdered chalk or limestone in suspension in the unheated oxidising gas, which may be pure oxygen, and which does not pass through the Cowper's stove, can be introduced directly into the blast furnace at the tuyeres. Supplementary means of controlling the basicity of the slag are therefore available.

It is also possible to inject fuel oil into the nozzle, in the known manner, where it mixes with the fuel oil injected at the periphery of the tuyere.

It is also possible to replace one or the other of the annular conduits with a ring of small orifices.

What is claimed is:

1. An improved tuyere for a blast furnace, wherein: said tuyere is defined by at least one metal component and being formed of three concentric conduits, said improvement comprises: a central conduit for receiving a hot gaseous blast and two annular conduits associated therewith, all of said conduits leading directly into said blast furnace; a plurality of small diameter channels disposed in proximity to a working end of said tuyere for providing communication between an outer annular conduit for fluid or emulsion containing hydrocarbons, and an intermediate annular conduit for the oxygen or oxidising gas, enabling atomization of part of the flow of hydrocarbons in the stream of oxygen or oxidising gas prior to exit of the tuyere and the remainder of the flow of hydrocarbons being contained in said outer conduit along a path defined by a progressively decreasing cross-section.

2. A tuyere according to claim 1, wherein: the cross-section of the outlet of said outer annular conduit plus the total of the cross-section of said small diameter channels is less than the cross-section of said outer annular conduit at a point before the inlet of said small diameter channels.

3. A tuyere according to claim 1, wherein the inner surface of the outer wall of the intermediate conduit has a venturi profile defined by a convergent portion, a throat and a divergent portion, and the small diameter channels terminate in a ring of small orifices which open into the divergent portion a small distance from the throat.

* * * * *